US007181777B2

(12) United States Patent
Choi et al.

(10) Patent No.: US 7,181,777 B2
(45) Date of Patent: Feb. 27, 2007

(54) SHIELD MOUNTING DEVICE FOR HELMET

(75) Inventors: Kwang-Moon Choi, Suwon-si (KR); Bom-Shik Cho, Yongin-si (KR)

(73) Assignee: HJC Co., Ltd., Kyunggi-do (KR)

( * ) Notice: Subject to any disclaimer, the term of this patent is extended or adjusted under 35 U.S.C. 154(b) by 273 days.

(21) Appl. No.: 11/027,302

(22) Filed: Dec. 31, 2004

(65) Prior Publication Data

US 2006/0117467 A1 Jun. 8, 2006

(30) Foreign Application Priority Data

Nov. 25, 2004 (KR) ..... 10-2004-0097364

(51) Int. Cl.
*A42B 1/08* (2006.01)

(52) U.S. Cl. ..... 2/424

(58) Field of Classification Search ..... 2/424
See application file for complete search history.

(56) References Cited

U.S. PATENT DOCUMENTS 5,062,162 A * 11/1991 Kamata ..... 2/424
5,177,816 A * 1/1993 Schmidt et al. ..... 2/424
5,461,731 A * 10/1995 Shida ..... 2/424
6,260,213 B1 * 7/2001 Eom et al. ..... 2/424
6,622,314 B1 * 9/2003 Kim et al. ..... 2/424
6,654,969 B2 * 12/2003 Taniuchi ..... 2/424
6,711,753 B2 * 3/2004 Arai ..... 2/424
7,065,798 B2 * 6/2006 Kuo ..... 2/424
2003/0182717 A1 * 10/2003 Choi et al. ..... 2/424

FOREIGN PATENT DOCUMENTS

JP 05214604 A * 8/1993

* cited by examiner

*Primary Examiner*—Rodney Lindsey
(74) *Attorney, Agent, or Firm*—R. Neil Sudoi; Henry D. Coleman; William J. Sapone

(57) ABSTRACT

The present invention relates to a shield mounting device for a helmet shield in which a helmet shield can be easily assembled and disassembled to/from a helmet body. The shield mounting device for a helmet comprises a mounting protrusion having a flange at an edge thereof; a mounting plate having an arc shaped groove capable of guiding an operation that the flange is inserted and rotated; a base plate having an elastic piece elastically moving in a direction that an external force is applied when the external force is applied to the mounting protrusion; and a locker having an escape prevention for preventing an escape of the mounting protrusion.

11 Claims, 14 Drawing Sheets

【Fig. 1】
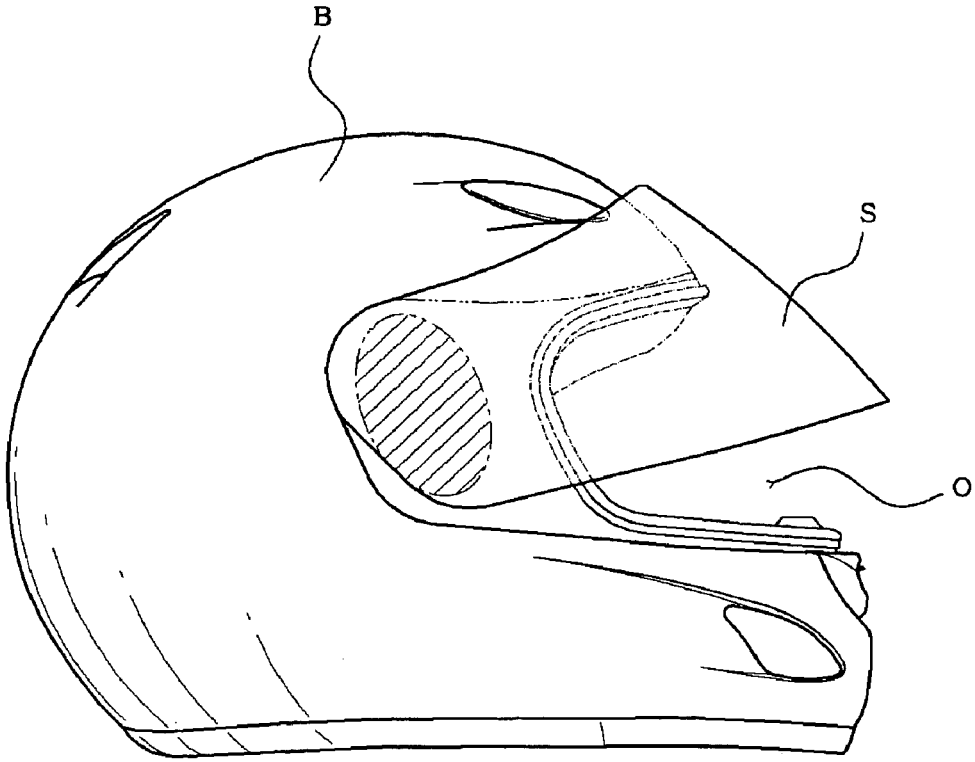

【Fig. 2】
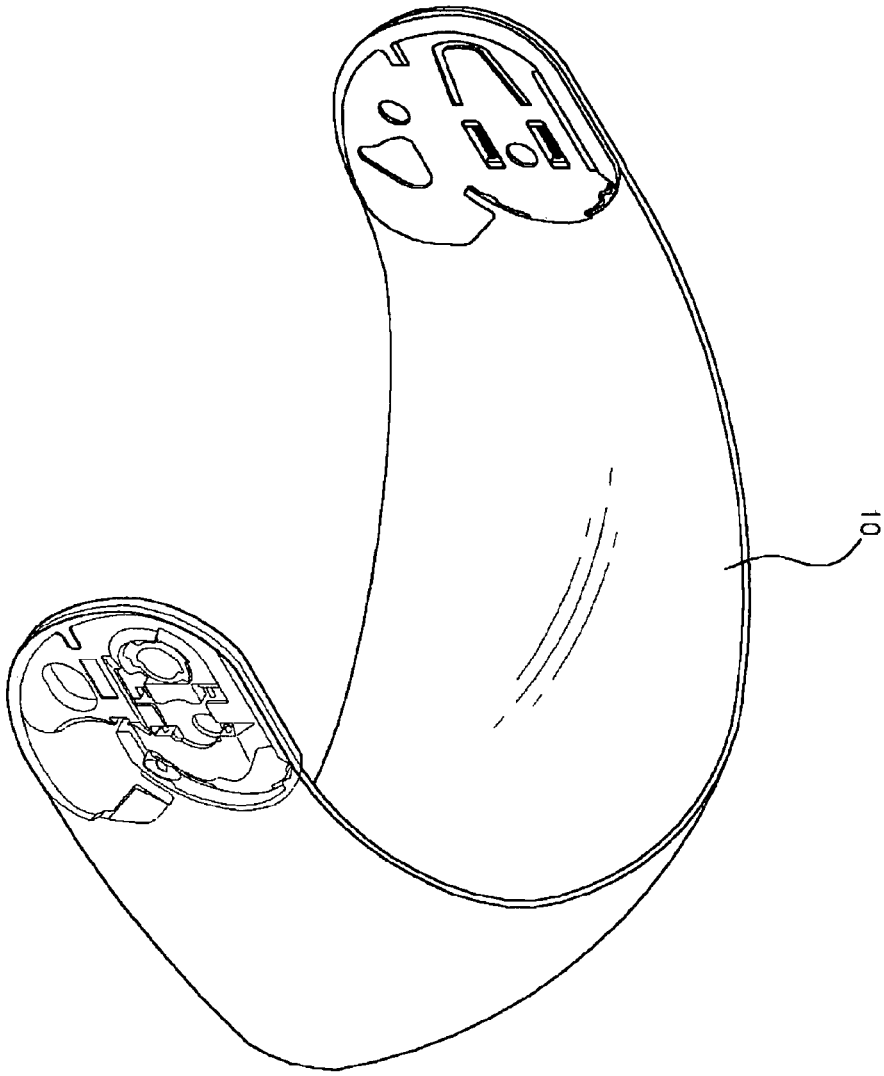

【Fig. 3】
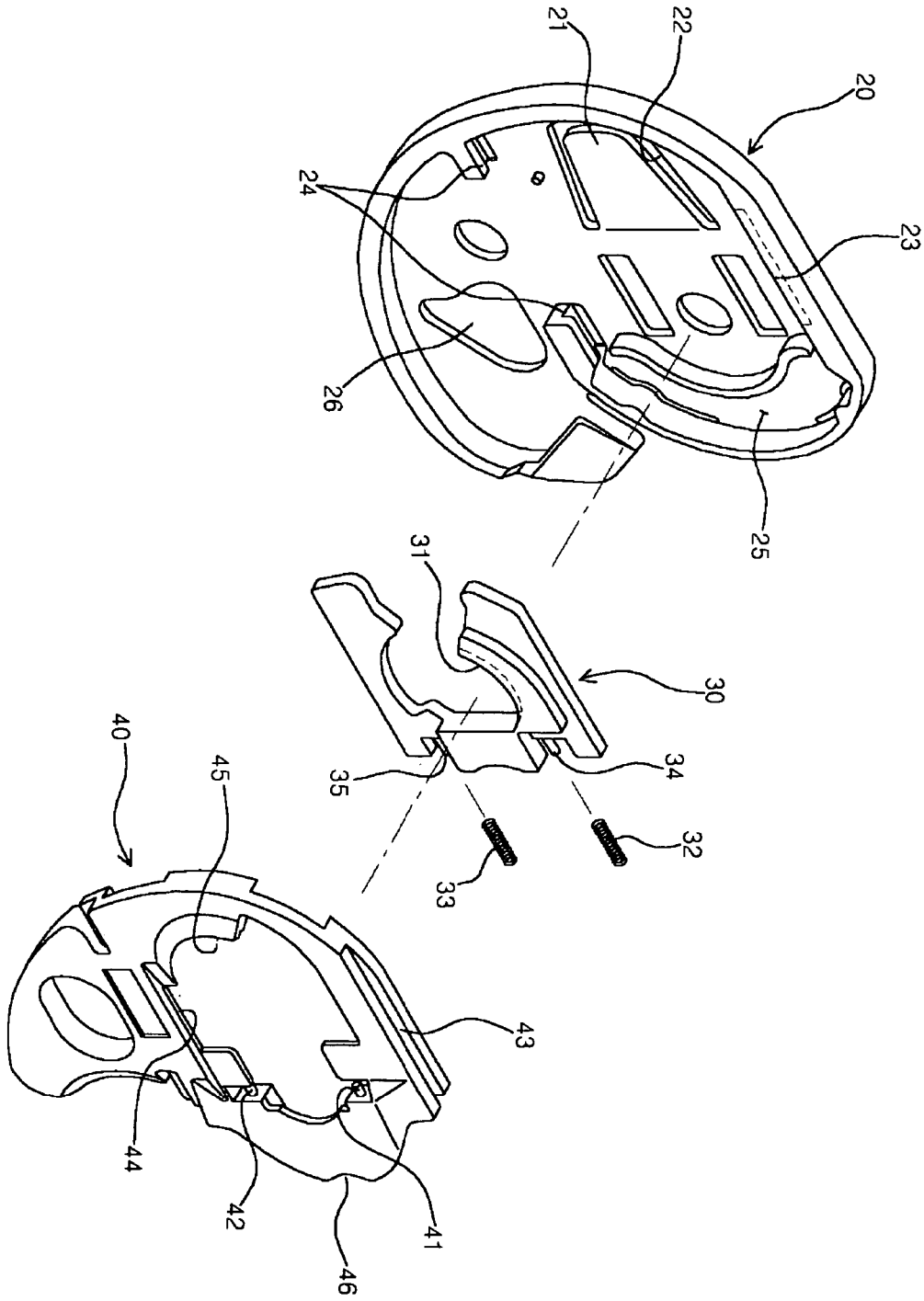

【Fig. 4】
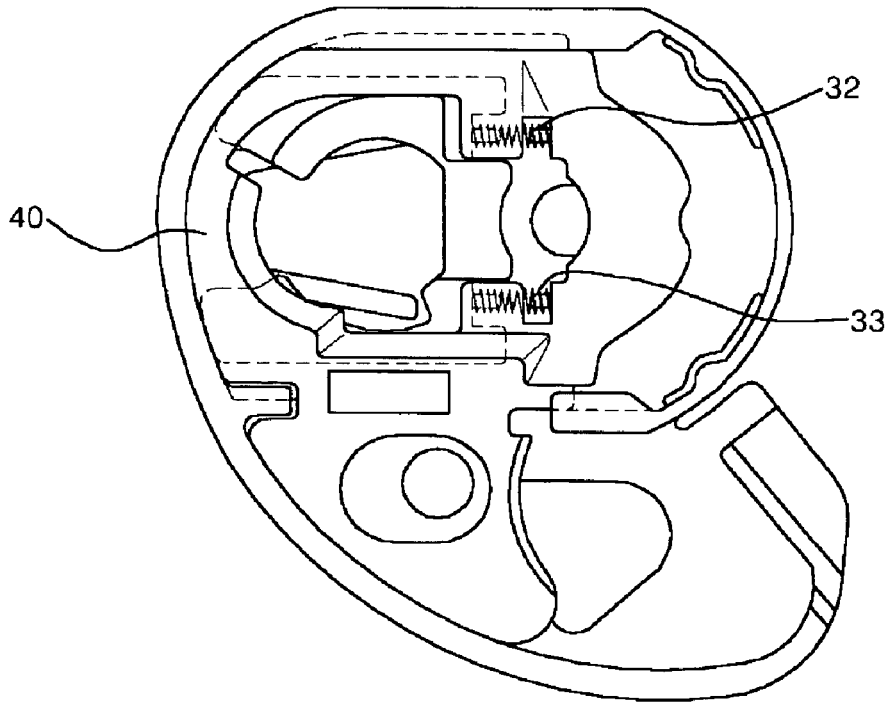

【Fig. 5】
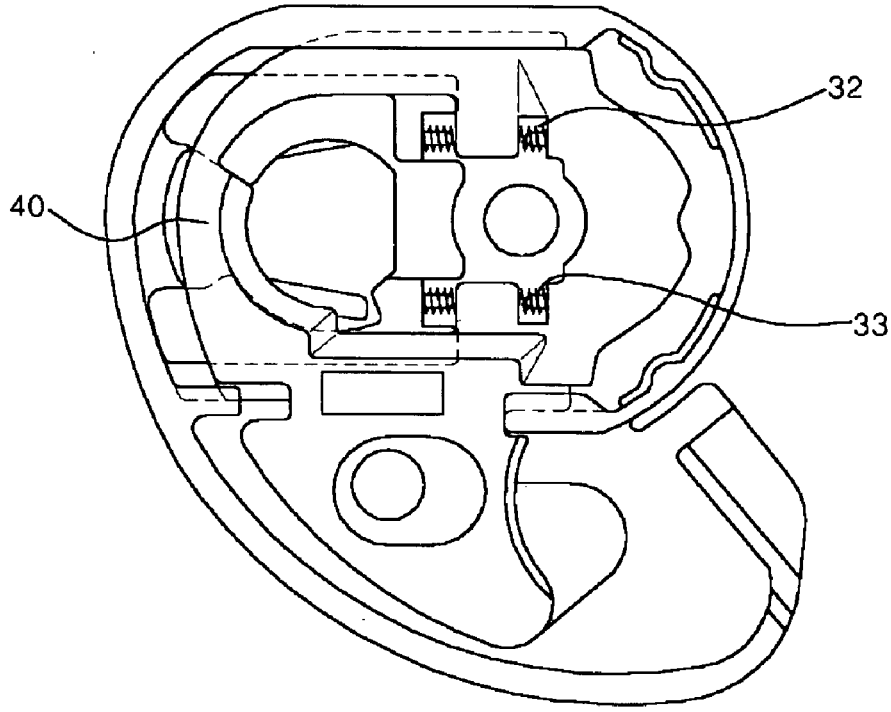

【Fig. 6】
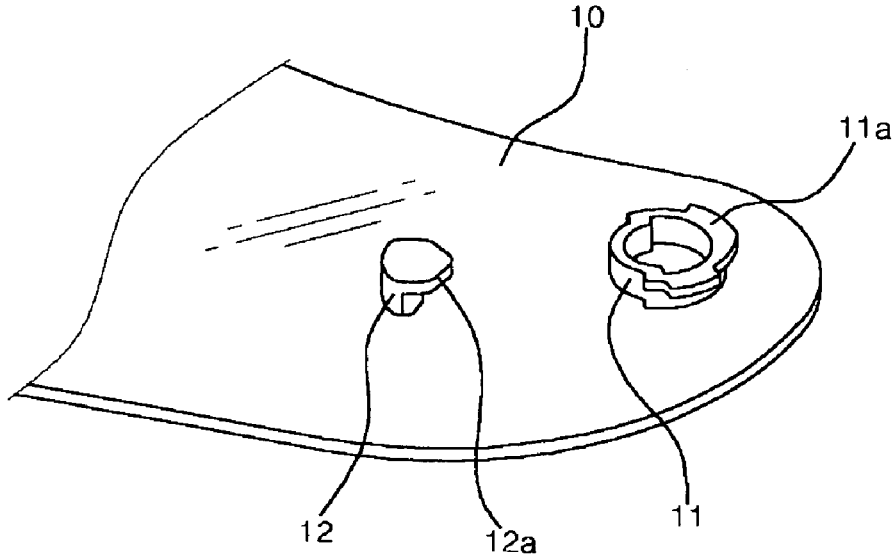

【Fig. 7】
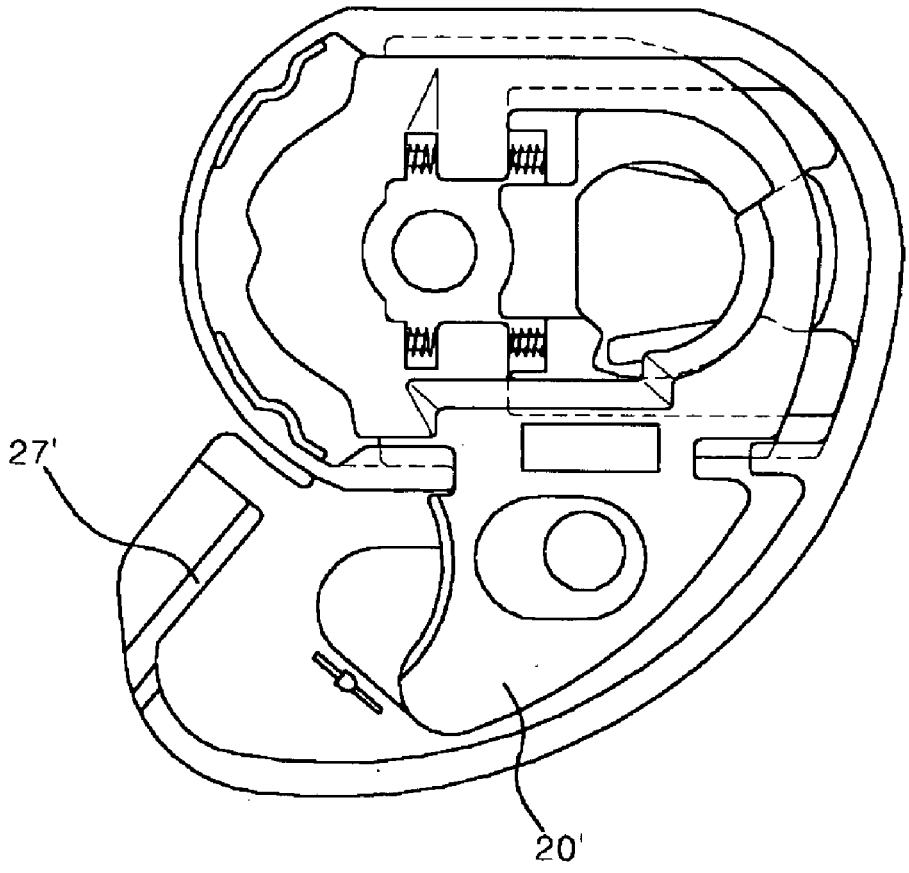

【Fig. 8】
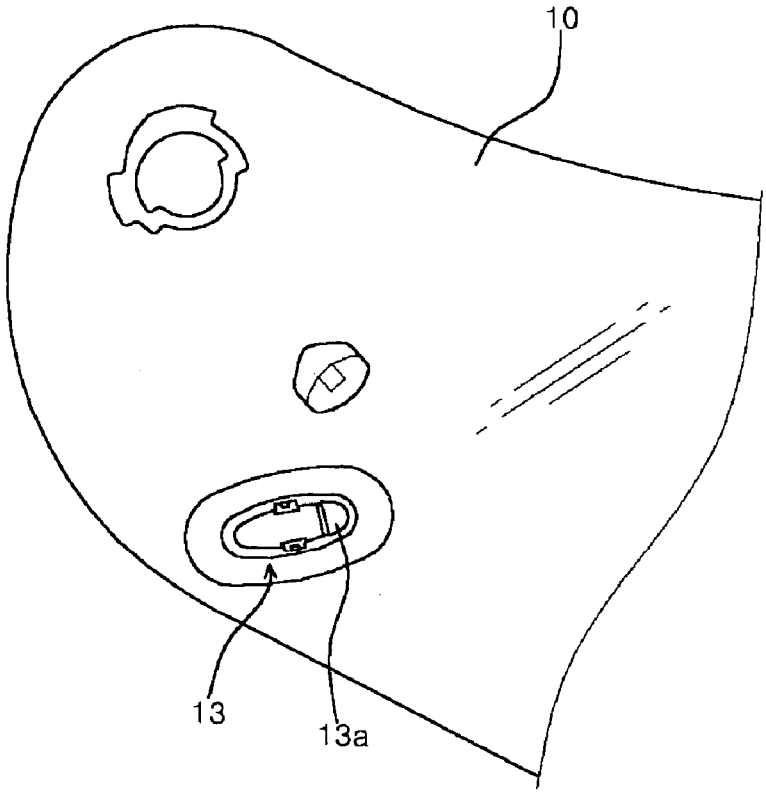

【Fig. 9】
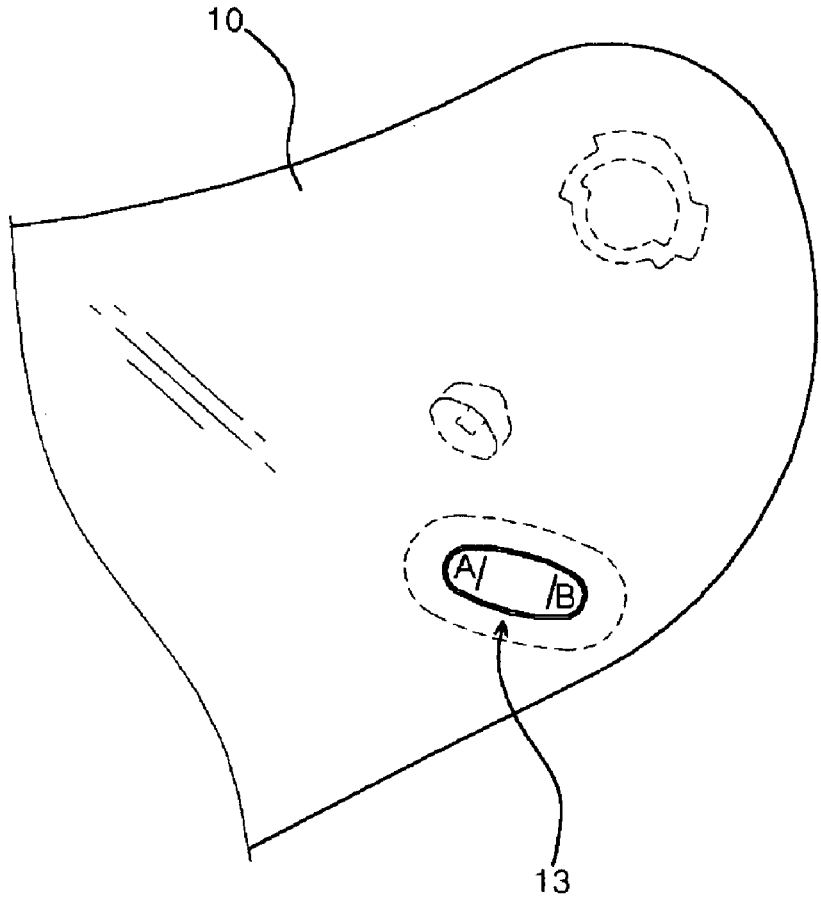

【Fig. 10】
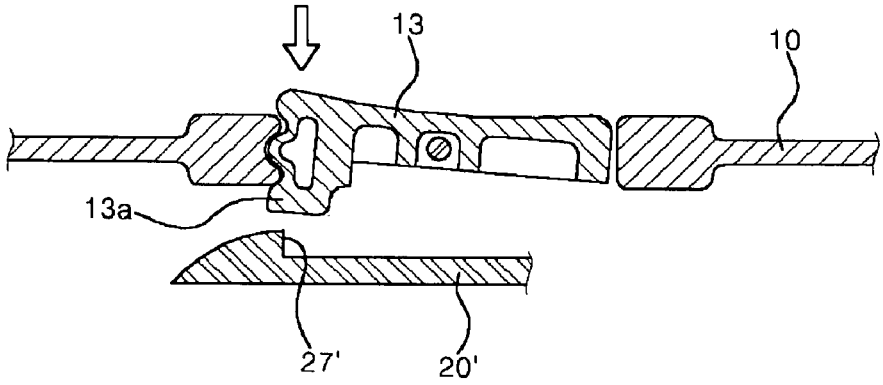

【Fig. 11】
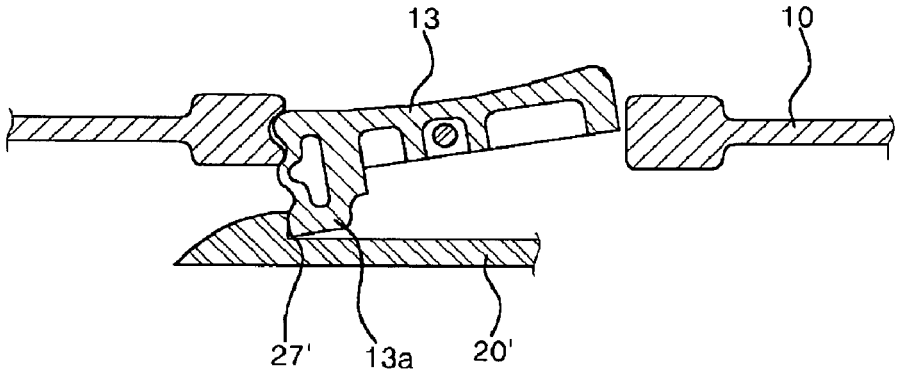

【Fig. 12】
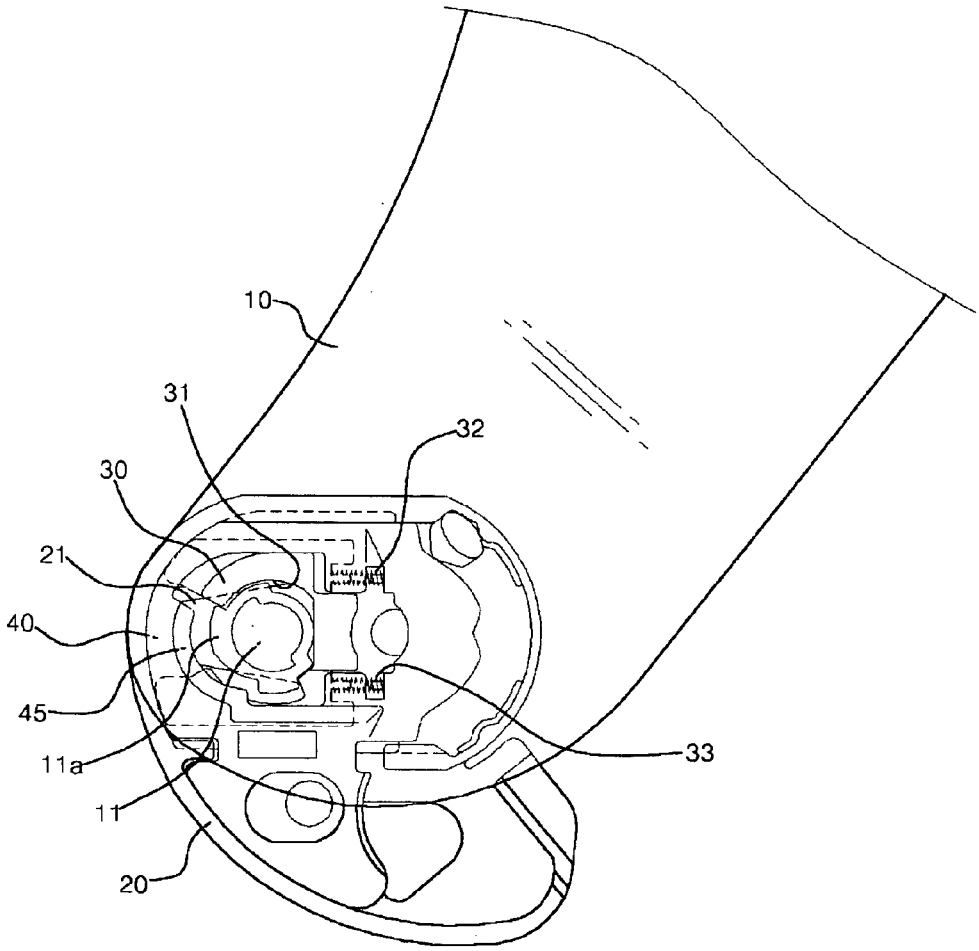

【Fig. 13】
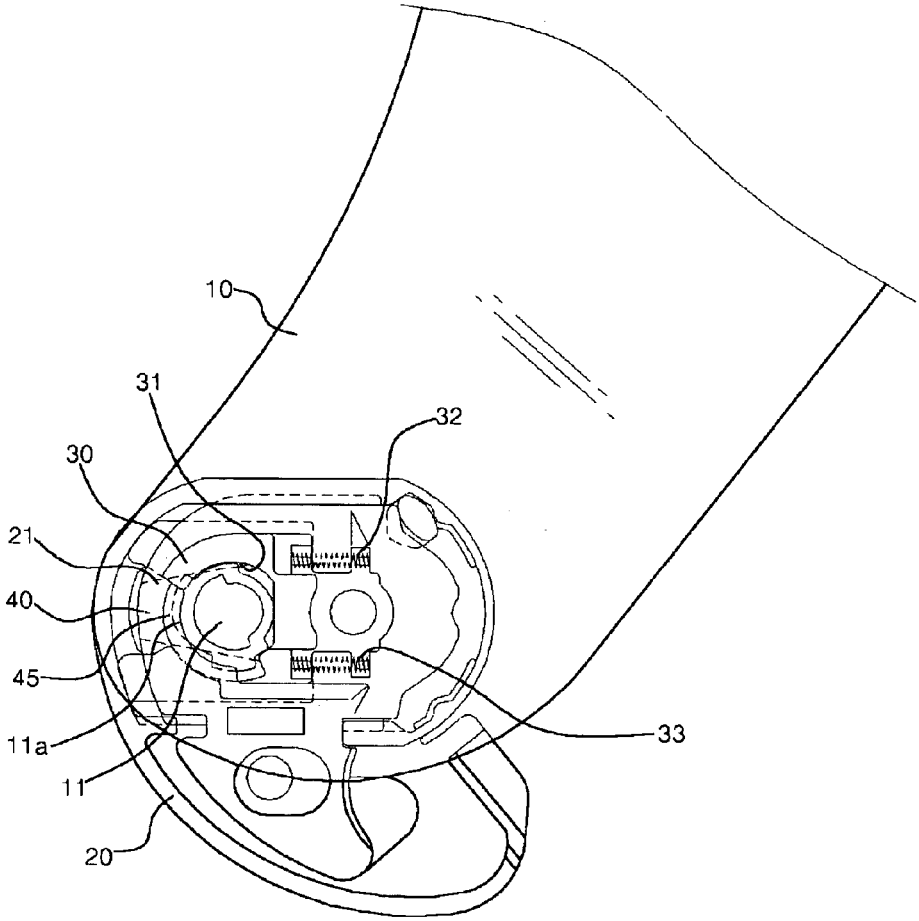

【Fig. 14】
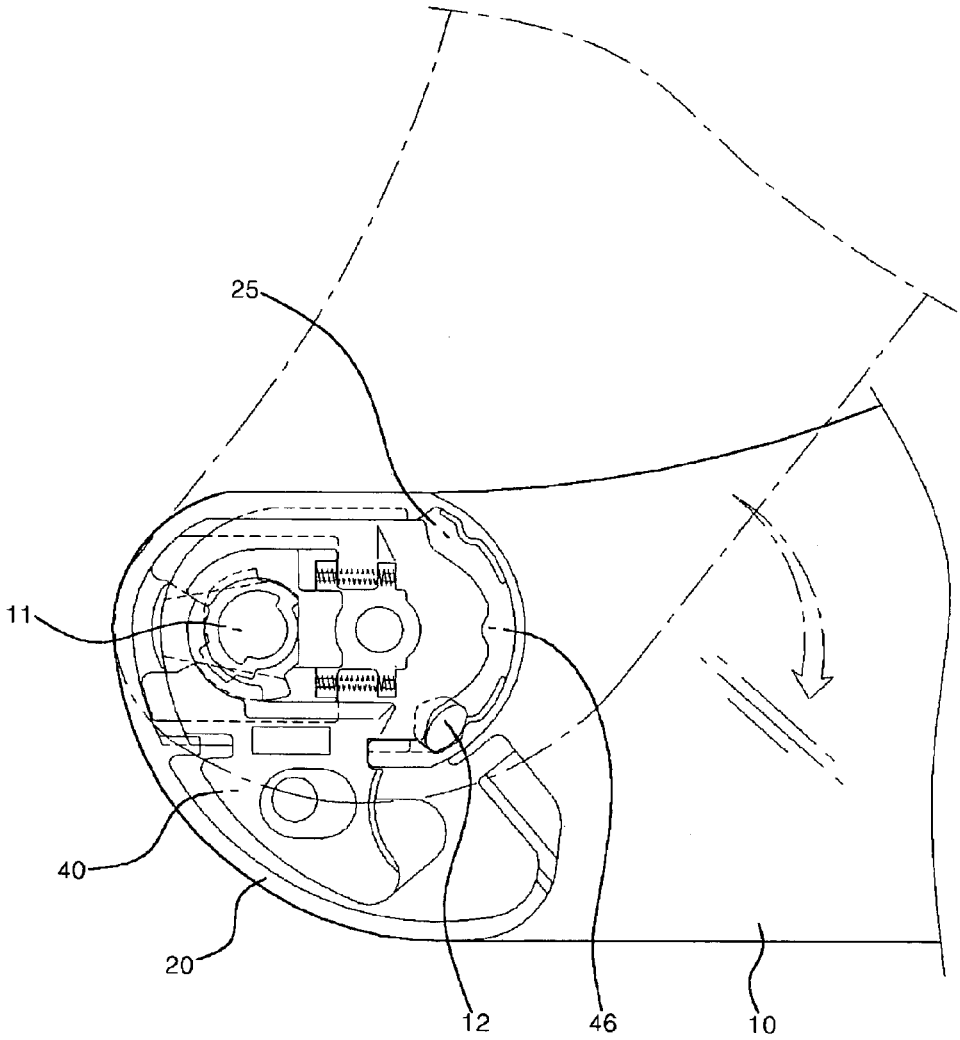

SHIELD MOUNTING DEVICE FOR HELMET

BACKGROUND OF THE INVENTION

1. Field of the Invention

The present invention relates to a helmet worn to a user's head when a person rides on a motorcycle, and in particular to a shield mounting device for helmet used when a shield adapted to protect a front side of a helmet user is assembled to a body of a helmet.

2. Description of the Background Art

In a motorcycle or a race vehicle, a rider or co-rider wears a protection gear such as a helmet for preventing his head from an accident.

As shown in FIG. 1, the helmet includes a body B having an opening O in a front side of the helmet in a structure that a head of a user is fully covered, and a front side of a user's face is exposed, and a shield S adapted to protect a user's face exposed through the opening of the body B from wind or a foreign substance and formed of a transparent material and assembled to the body B. In particular, the shield S is assembled to a portion (the hatched portion of FIG. 1) of both sides of the body B by a mounting device. In the mounting device, the shield S assembled to the body B is rotated up and down, so that the opening O of the body B is opened or closed.

As an example of a conventional shield mounting device, according to the U.S. patent application Ser. No. 6,260,213 filed on Nov. 15, 1999, there is provided a shield connector. In the shield connector of the U.S. patent application Ser. No. 6,260,213, a base plate includes a circular guide, and an insertion and guiding portion communicating with the guide and is fixed to a helmet body. A rotation member is rotatably inserted into the guide of the base plate. A connection member is formed at an inner surface of the shield and is inserted into the rotation member through the insertion and guiding portion. In addition, a locker is installed rotatably along an outer surface of the guide and is adapted to lock the connection member inserted into the rotation member. However, according to the shield mounting device disclosed in the US patent application, in a state that the rotation member is inserted into the inner side of the guide of the base plate, and the locker is engaged to an outer surface of the guide, the connection member of the shield is slid into the inner side of the rotation member through the insertion and guiding portion of the base plate and then is assembled. In the above state, the locker is rotated, and the connection member is locked for thereby completing the assembling procedure of the shield. In the conventional art, the assembling procedure is complicated and inconvenience. Therefore, the productivity of the helmet is decreased. In addition, since the guide, the rotation member, the connection member and the locker have tight assembling sizes, each assembling operation is easily performed, but it is very difficult to disassemble the assembled parts. Therefore, there are many problems for separating the shield from the helmet for the purpose of cleaning or exchange.

SUMMARY OF THE INVENTION

It is an object of the present invention to overcome the problems encountered in the conventional art.

It is another object of the present invention to provide a shield mounting device for a helmet capable of easily assembling and disassembling a helmet shield to/from a helmet body.

To achieve the above objects, there is provided a shield mounting device for helmet, comprising a mounting protrusion that is protruded from an inner surface of a helmet shield and includes a flange at an edge; a mounting plate that includes an arc shaped groove capable of guiding an operation that the flange is inserted and rotated in a state that the mounting protrusion is inserted; a base plate that includes an elastic piece elastically moving in a direction that an external force is applied when the external force is applied to the mounting protrusion in a state that the mounting plate is assembled and the mounting protrusion is inserted into the mounting plate; and a locker that is assembled between the mounting plate and the springs in such a manner that the locker slides in a direction that springs are compressed and that includes an escape prevention piece that slides in a direction that the springs are extended when the elastic piece is elastically moved by an external force applied to the mounting protrusion, so that it is inserted between a flange of the mounting protrusion and an inner surface of the shield for thereby preventing an escape of the mounting protrusion.

In the present invention, the flange of the mounting protrusion is formed in an arc shape.

A plurality of protrusions is formed at the mounting plate and locker assembled springs for thereby supporting the springs.

It comprise further that a guide protrusion having a flange is protruded from an inner surface of the shield, and an arc shaped rotation guide groove is formed at the base plate for guiding the guide protrusion when the shield is rotated. An end portion of the locker arranged in a direction of the rotation guide groove of the base plate is formed in an arc shape, and an end portion of the locker includes an engaging groove for engaging the guide protrusion so that the shield is not downwardly moved by its self-weight in a state that the shield is opened in half. The guide protrusion includes a flange for prevent the shield from escaping in such a manner that the flange is inserted below a lower side of the locker when the locker slides in a direction that the springs are extended.

A first stepped part is formed at an upper side of the locker, and a slot is formed at the base plate for thereby guiding a sliding operation of the locker in such a manner that the first stepped part is inserted in a state that the locker is assembled.

A second stepped part is formed at an intermediate portion of the locker, and a ]—shaped guider is formed at an intermediate portion of the base plate for thereby guiding a sliding operation of the locker in such a manner that the second stepped part is inserted in a state that the locker is assembled.

An arc shaped finger groove is formed at a lower side of the locker for thereby sliding the locker using fingers. A finger hole is formed at a lower side of the base plate so that a certain finger is inserted thereinto for thereby operating the finger groove.

A locking button is provided at the shield and has a locking protrusion protruded in the direction of the base plate, and the base plate includes a rotation prevention wall to prevent the shield from rotating in such a manner that the locking protrusion is blocked during a locking operation of the locking button.

BRIEF DESCRIPTION OF THE DRAWINGS

The present invention will become better understood with reference to the accompanying drawings which are given only by way of illustration and thus are not limitative of the present invention, wherein;

FIG. 1 is a lateral view of a conventional helmet having a shield mounted therein;

FIG. 2 is a perspective view of a shield having a shield mounting device according to the present invention;

FIG. 3 is a disassembled perspective view of major elements of a shield mounting device assembled to a right side of the shield of FIG. 2;

FIG. 4 is a front view illustrating an assembled state of FIG. 3;

FIG. 5 is a front view illustrating a state that a locker is moved to a locking position in FIG. 4;

FIG. 6 is a view illustrating an inner part of a right side of the shield of FIG. 2;

FIG. 7 is a front view illustrating an assembled state of the elements assembled to a left side of the shield of FIG. 2 corresponding to FIG. 4;

FIG. 8 is a view illustrating an inner part of a left side of the shield of FIG. 2;

FIG. 9 is a view illustrating an outer part of a left side of the shield of FIG. 2;

FIG. 10 is a cross sectional view taken in such a manner that a construction before a locking operation of a locking button is viewed from a lower part of a shield;

FIG. 11 is a cross sectional view taken in such a manner that a construction after a locking operation of a locking button is viewed from a lower part of a shield;

FIG. 12 is a view illustrating an initial state that a shield mounting device is assembled to a shield;

FIG. 13 is a view of a locking state in FIG. 12; and

FIG. 14 is a view of a state that a shield is lowered in FIG. 13.

DETAILED DESCRIPTION OF THE PREFERRED EMBODIMENTS

The preferred embodiments of the present invention will be described with reference to the accompanying drawings.

FIG. 2 is a perspective view of a shield having a shield mounting device according to the present invention. As shown therein, a shield mounting device according to the present invention is symmetrically provided at the both sides of a shield 10, respectively.

FIG. 3 is a disassembled perspective view of major elements of a shield mounting device assembled at a right side of the shield of FIG. 2. As shown therein, there are provided a base plate 20, a mounting plate 30 and a locker 40. In particular, the mounting plate 30 and the locker 40 are sequentially assembled on the base plate 20. In an assembled state, a mounting protrusion 11 of the shield 10 of FIG. 6 is inserted into the mounting plate 30.

The base plate 20 includes one elastic piece 21 at one side. The elastic piece 21 is integrally provided at the base plate 20 in cooperation with a cut-away hole 22 thinly formed at the base plate 20 and is slightly slanted from the flat surface of the base plate 20 to the upper side. Therefore, a certain external force is applied to the mounting protrusion 11 in a state that the mounting protrusion 11 is inserted into the mounting plate 30 assembled to the base plate 20, the elastic piece 21 is elastically moved in the direction that the external force is applied.

In addition, the mounting plate 30 includes an arc shaped groove 31 into which the mounting protrusion 11 of the shield 10 is inserted. A flange 11*a* formed at an edge of the mounting protrusion 11 is inserted into the arc shaped groove 31 and is rotated.

The locker 40 is a member for locking the mounting protrusion 11 inserted into the mounting plate 30 and is installed on the base plate 20 between the mounting plate 30 and springs 32, 33. The springs 32, 33 are inserted into a pair of protrusions 34, 35 and 41, 42 formed on the mounting plate 30 and the locker 40. Therefore, the mounting plate 30 is fixed on the base plate 20 solidly, the locker 40 is designed to slide in the direction that the springs 32, 33 are compressed or extended. As shown in FIG. 4, the state that the locker 40 compresses the springs 32, 33 corresponds to the state before the mounting protrusion 11 is locked. As shown in FIG. 5, the state that the locker 40 slides and then extends the springs 32, 33 corresponds to the state that the mounting protrusion 11 is locked. A first stepped part 43 and a second stepped part 44 respectively are formed at the upper and intermediate portions of the locker 40, a slot 23 capable of guiding a sliding operation of the locker 40 and a ]—shaped guider 24 are formed in the base plate 20 wherein the first stepped part 43 and the second stepped part 44 are inserted in a state that the locker 40 is assembled, so that it is possible to achieve a sliding operation of the locker 40 smoothly. An escape prevention piece 45 is provided at one side of the locker 40 for thereby preventing an escape of the mounting protrusion 11 of the shield inserted into the mounting plate 30. The escape prevention piece 45 is formed in an arc shape for thereby forming a semi-circular shape together with the arc shaped groove 31 of the mounting plate 30. When the locker 40 is assemble on the base plate 20 and the escape prevention piece 45 is pushed to the end in the direction that the springs 32, 33 are compressed, the lower side of the escape prevention piece 45 is supported by the end of the elastic piece 21 for thereby maintaining a state that the springs 32, 33 are compressed. At this time, when an external force is applied to the mounting protrusion 11 in a state that the mounting protrusion 11 of the shield is assembled to the mounting plate 30, the elastic piece 21 is elastically moved, and the locker 40 is released from the state that the locker 40 is supported by the elastic piece 21 and is slid in the direction that the springs 32, 33 are extended. The escape prevention piece 45 is inserted between the flange 11*a* of the mounting protrusion 11 and the inner surface of the shield 10, so that the mounting protrusion 11 is not escaped.

As shown in FIG. 6, the mounting protrusion 11 of the shield 10 is protruded from the inner surface of the shield 10, and the flange 11*a* is provided at an edge of the end of the mounting protrusion 11. At this time, since the flange 11*a* is formed in an arc shape, the mounting protrusion 11 of the shield 10 is inserted into both the arc shaped groove 31 of the mounting plate 30 and the escape prevention piece 45 of the locker 40 and is rotated.

In addition, one guide protrusion 12 is protruded from an inner surface of the shield 10 separately from the mounting protrusion 11. An arc shaped rotation guide groove 25 is formed at the base plate 20 for guiding the guide protrusion 12 when the shield 10 is rotated. In particular, the flange 12*a* is formed at the guide protrusion 12. The flange 12*a* is inserted below the lower side of the locker 40 when the locker 40 is pushed in the direction that the springs 32, 33 are extended, so that it is possible to achieve a stable mounting state between the shield 10 and the shield mounting device together with the mounting protrusion 11.

As shown in FIG. 3, the end portion of the locker 40 arranged in the direction of the rotation guide groove 25 of the base plate 20 has an arc shape along a trace that the guide protrusion 12 is rotated. An engaging groove 46 is formed at the intermediate portion of the locker for engaging the guide protrusion 12. Therefore, the guide protrusion 12 is caught by the engaging groove 46 in a state that the shield 10 is opened in half, so that the shield 10 is not downwardly moved by its self-weight.

An arc shaped finger groove is further formed at the lower portion of the locker 40 for sliding the locker 40. A finger hole 26 is formed at the lower portion of the base plate 20 so that a certain finger is inserted thereinto for operating the finger groove. Therefore, it is possible to achieve an easier sliding operation of the locker 40.

In the above, the shield mounting device installed at the right side of the shield 10 was described as one example. As shown in FIG. 7, the shield mounting device installed at the left side of the shield has the same construction as the above-described.

As shown in FIGS. 8 and 9, a locking button 13 may be installed at the left side or the right side of the shield 10. As shown in FIGS. 8 and 9, the locking button 13 is provided at an inner of the left side of the shield 10. The locking button 13 may be installed at the right side instead of at the left side of the shield 10. The locking button 13 is generally formed in a seesaw switch button structure. A locking protrusion 13*a* is formed at the end portion formed in the direction of the inner surface of the shield 10. Namely, the locking protrusion 13*a* of FIG. 8 is formed at the back of the portion A of the locking button 13 of FIG. 9.

As shown in FIG. 7, a rotation prevention wall 27' is protruded and formed at a base plate 20', corresponding to the locking button 13. In a state that the portion B of the locking button 13 of FIG. 9 is pushed, as shown in FIG. 10, the locking protrusion 13*a* is free from the rotation prevention wall 27' of the base plate 20'. Therefore, the shield 10 is freely rotated with respect to the base plate 20'. In a state that the portion A of the locking button 13 of FIG. 9 is pushed, as shown in FIG. 11, the locking protrusion 13*a* is positioned at the portion blocked by the rotation prevention wall 27' of the base plate 20'. In the above state, when the shield 10 is rotated, since the rotation path of the locking protrusion 13*a* is blocked by the rotation prevention wall 27', the shield 10 is not rotated. Namely, the locking button 13 and the rotation prevention wall 27' have a function capable of preventing an unnecessary rotation when the shield 10 is assemble to the helmet.

The operation that the shield mounting device according to the present invention is assembled to the helmet will be described with reference to the accompanying drawings.

FIG. 12 is a view illustrating an initial state that a shield mounting device is assembled to the shield. As shown therein, the locker 40 is pushed up to the end on the base plate 20 in the direction that the springs 32, 33 are compressed, and the lower portion of the escape prevention piece 45 is supported by the end portion of the elastic piece 21. Therefore, it is possible to maintain a state that the springs 32, 33 are compressed. In the above state, the mounting protrusion 11 of the shield 11 is inserted between the arc shaped groove 31 of the mounting plate 30 and the escape prevention piece 45 of the locker 40 with a tight engagement.

When a certain external force is applied to the mounting protrusion 11 in FIG. 12, the elastic piece 21 of the base plate 20 is elastically moved and is escaped from the lower side of the escape prevention piece 45 of the locker 40. Thereafter, the locker 40 slides in the direction that the springs 32, 33 are extended, so that the construction of FIG. 13 is achieved. Therefore, the escape prevention piece 45 is inserted between the flange 11*a* of the mounting protrusion 11 and the inner of the shield 10, so that the locker 40 locks the mounting protrusion 11.

When the shield 10 is downwardly rotated with respect to the mounting protrusion 11 as a rotation axis, the construction of FIG. 14 is achieved. At this time, since the guide protrusion 12 of the shield 10 is guided by the rotation guide groove 25 of the base plate 20, it is possible to achieve an easier rotation of the shield 10. In the case that a user wants a half opening of the shield 10 with respect to the helmet, it is needed to engage the guide protrusion 12 of the shield 10 with the engaging groove 46 of the locker 40. At this time, the state that the guide protrusion 12 of the shield 10 is engaged with the engaging groove 46 of the locker 40 is maintained unless the shield 10 is forced to rotate.

Furthermore, when the shield 10 is intended not to be rotated with respect to the shield mounting device, as shown in FIGS. 8 through 11, the locking protrusion 13*a* is controlled not to move by the rotation prevention wall 27' of the base plate 20' by operating the locking button 13.

In the case that the shield 10 is disassembled from the shield mounting device, the following procedures are performed.

The portion B of the locking button 13 of the shield 10 is pushed, so that the locking protrusion 13*a* is released from the rotation prevention wall 27' for thereby achieving a free rotation of the shield 10.

Subsequently the shield 10 is rotated for thereby achieving the construction of FIG. 13. A certain finger is inserted into the finger hole 26 of the base plate 20, and the locker 40 is pushed in a state that the finger contacts with the finger groove 47 of the locker 40.

So then, the locker 40 slides in the direction that the springs 32, 33 are compressed, and the lower side of the escape prevention piece 45 is fixedly caught by the end of the elastic piece 21 of the base plate 20. In the above state, the flange 11*a* of the mounting protrusion 11 is released from the escape prevention piece 45 of the locker 40.

In the above state, when the shield 10 is escaped between the arc shaped groove 31 of the mounting plate 30 and the escape prevention piece 45 of the locker 40, the shield 10 is fully disassembled from the shield mounting device.

The assembly of the base plate 20, the mounting plate 30 and the locker 40 is stably engaged with the shield 10 by the mounting protrusion 11 of the shield 10 in a state that it is assembled to the body of the helmet.

As described above, in the shield mounting device for a helmet according to the present invention, the helmet shield can be easily attached and detached to/from the helmet body. The assembling operation of the shield can be quickly achieved during the fabrication of the helmet. The productivity is significantly enhanced.

In addition, a helmet user can easily disassemble the shield from the helmet body, and achieve an easier assembling process. In the present invention, the work for cleaning or exchange the shield can be easily performed, so that the convenience of use can be significantly enhanced.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A shield mounting device for a helmet, comprising:

a mounting protrusion that is protruded from an inner surface of a helmet shield and includes a flange at an edge;

a mounting plate that includes an arc shaped groove capable of guiding an operation that the flange is inserted and rotated in a state that the mounting protrusion is inserted;

a base plate that includes an elastic piece elastically moving in a direction that an external force is applied when the external force is applied to the mounting protrusion in a state that the mounting plate is assembled and the mounting protrusion is inserted into the mounting plate; and a locker that is assembled between the mounting plate and the springs in such a manner that said locker slides in a direction that springs are compressed and that includes an escape prevention piece that slides in a direction that the springs are extended when the elastic piece is elastically moved by an external force applied to the mounting protrusion, so that it is inserted between a flange of the mounting protrusion and an inner surface of the shield for thereby preventing an escape of the mounting protrusion.

2. The device of claim 1, wherein said flange of the mounting protrusion is formed in an arc shape.

3. The device of claim 1, wherein a plurality of protrusions is formed at the mounting plate and locker having assembled springs for thereby supporting the springs.

4. The device of claim 1, further comprising a guide protrusion protruded from an inner surface of the shield, and an arc shaped rotation guide groove formed at the base plate for guiding the guide protrusion when the shield is rotated.

5. The device of claim 4, wherein said guide protrusion includes a flange for preventing the shield from escaping in such a manner that the flange is inserted below a lower side of the locker when the locker slides in a direction that the springs are extended.

6. The device of claim 4, wherein an end portion of the locker arranged in a direction of the rotation guide groove of the base plate is formed in an arc shape, and an end portion of the locker includes an engaging groove for engaging the guide protrusion so that the shield is not downwardly moved by its self-weight in a state that the shield is opened in half.

7. The device of claim 1, wherein a first stepped part is formed at an upper side of the locker, and a slot is formed at the base plate for thereby guiding a sliding operation of the locker in such a manner that the first stepped part is inserted in a state that the locker is assembled.

8. The device of claim 1, wherein a second stepped part is formed at an intermediate portion of the locker, and a ]—shaped guider is formed at an intermediate portion of the base plate for thereby guiding a sliding operation of the locker in such a manner that the second stepped part is inserted in a state that the locker is assembled.

9. The device of claim 1, wherein an arc shaped finger groove is formed at a lower side of the locker for thereby sliding the locker.

10. The device of claim 9, wherein a finger hole is formed at a lower side of the base plate so that a certain finger is inserted thereinto for thereby operating the finger groove.

11. The device of claim 1, wherein a locking button is provided at the shield and has a locking protrusion protruded in the direction of the base plate, and said base plate includes a rotation prevention wall designed to prevent the shield from rotating in such a manner that the locking protrusion is blocked during a locking operation of the locking button.

* * * * *